US009511411B2

(12) United States Patent
Tielbeke et al.

(10) Patent No.: US 9,511,411 B2
(45) Date of Patent: Dec. 6, 2016

(54) TAB FOR A CLOSURE AND PROCESS FOR MAKING SUCH TAB

(75) Inventors: Gerardus Johannes Josephus Tielbeke, Raalte (NL); Aart Leendert Emmerzaal, Deventer (NL)

(73) Assignee: Impress Group B.V., Deventer (NL)

( * ) Notice: Subject to any disclaimer, the term of this patent is extended or adjusted under 35 U.S.C. 154(b) by 1122 days.

(21) Appl. No.: 12/374,758

(22) PCT Filed: Jul. 16, 2007

(86) PCT No.: PCT/EP2007/006357

§ 371 (c)(1),
(2), (4) Date: Dec. 9, 2009

(87) PCT Pub. No.: WO2008/012014

PCT Pub. Date: Jan. 31, 2008

(65) Prior Publication Data

US 2010/0126994 A1 May 27, 2010

(30) Foreign Application Priority Data

Jul. 24, 2006 (EP) ..... 06076465

(51) Int. Cl.

| | |
|---|---|
| ***B65D 17/34*** | (2006.01) |
| ***B21D 51/38*** | (2006.01) |
| ***B65D 17/00*** | (2006.01) |

(52) U.S. Cl.

CPC ..... *B21D 51/383* (2013.01); *B65D 17/163* (2013.01); *B65D 2517/0016* (2013.01); *B65D 2517/0062* (2013.01)

(58) Field of Classification Search

CPC ..... B65D 17/163; B65D 17/165
USPC ..... 220/273, 270, 276, 906, 272, 254.7, 220/269; 413/25, 67, 56, 16, 17, 14, 66
See application file for complete search history.

(56) References Cited

U.S. PATENT DOCUMENTS

| | | | | |
|---|---|---|---|---|
| 3,221,924 | A * | 12/1965 | Harvey | B21D 39/032 220/231 |
| 3,437,229 | A | 4/1969 | Khoury | |
| 3,667,643 | A * | 6/1972 | Patel | 220/270 |
| 3,744,669 | A | 7/1973 | Cospen et al. | |
| 3,929,252 | A * | 12/1975 | La Croce | 220/269 |
| 3,977,561 | A * | 8/1976 | Strobe et al. | 220/269 |
| 4,024,981 | A * | 5/1977 | Brown | 220/269 |
| 4,030,631 | A * | 6/1977 | Brown | 220/269 |
| 4,042,144 | A * | 8/1977 | Henning et al. | 220/273 |

(Continued)

FOREIGN PATENT DOCUMENTS

| | | |
|---|---|---|
| EP | 1 205 392 A1 | 5/2002 |
| JP | 2000-128167 A | 5/2000 |

(Continued)

*Primary Examiner* — Jacob K Ackun
*Assistant Examiner* — Jenine Pagan
(74) *Attorney, Agent, or Firm* — The Webb Law Firm

(57) ABSTRACT

The invention relates to a tab for a closure, comprising a tab body having at one side a tab nose for opening the closure, and at the other side a tab lever having a finger opening for activating the tab lever, which finger opening is surrounded by a distal lever part connected by lateral lever legs to the tab body, wherein in the lever legs are formed aligned hinge parts in the form of lateral lever leg parts of reduced bending strength, to a closure and container comprising such tab, and to a process for making such tab.

5 Claims, 4 Drawing Sheets

(56) References Cited

U.S. PATENT DOCUMENTS

| | | | | |
|---|---|---|---|---|
| 4,205,760 | A * | 6/1980 | Hasegawa | 220/271 |
| 4,247,014 | A * | 1/1981 | Walz | 220/269 |
| 4,399,925 | A * | 8/1983 | Fundom | 220/269 |
| 4,524,879 | A | 6/1985 | Fundom et al. | |
| 5,007,554 | A * | 4/1991 | Hannon et al. | 220/269 |
| 5,916,337 | A | 6/1999 | Caniglia et al. | |
| 6,026,971 | A * | 2/2000 | Lundgren | 220/269 |
| 6,234,337 | B1 * | 5/2001 | Huber et al. | 220/273 |

FOREIGN PATENT DOCUMENTS

| | | |
|---|---|---|
| WO | 00/09406 A1 | 2/2000 |
| WO | 01/28875 A1 | 4/2001 |

* cited by examiner

TAB FOR A CLOSURE AND PROCESS FOR MAKING SUCH TAB

BACKGROUND OF THE INVENTION

1) Field of the Invention

The present invention relates to a tab for a closure, to a closure comprising such a tab connected to the closure, to a container comprising a closure provided with such tab, and to a process for making such tab.

2) Brief Description of the Prior Art

Containers such as food and beverage cans are provided with a closure which may be opened with a tab connected to the closure. The tab is grasped by the users finger and due to a lever action exerted with the tab, the closure is popped open. Subsequently, part of the closure is pushed in or torn off, thereby making the content of the container available to the user. An example of such a closure is an easy opening end.

Generally, the force required for popping open the closure, the push in force or the tear force are not experienced by the user as excessive and do not interfere with the objective of easy opening the container. However, the initial lifting of the tab out of the plane of the closure over the first millimeters may be considered problematic.

In the art several closures are disclosed in order to improve the initial lifting and subsequent popping and tearing of the closure by the tab.

EP 1,205,392 discloses a tab which is provided with a tab lever formed by a separate flexible operating part such as a plastic strand.

U.S. Pat. No. 5,916,337 discloses a closure of which the tab is provided with an additional pull ring which extends through the tab opening.

JP 2000-128167 discloses a closure having a tab of which the tab body is provided with a crease line around which the lever part of the tab may be articulated thereby improving the grasping of the tab. However, the pop force and tear force will be increased due to the location of the crease line near the center of the tab.

SUMMARY OF THE INVENTION

The present invention has for its object to provide a tab for a closure of which the lifting force and lifting action will be appreciated by the user as elegant and for popping and/or tearing off the closure the user will not be confronted with required excessive forces to be applied. Still, such tab is to be produced using traditional manufacturing methods. Finally, failure during production and during use is generally to be avoided. With such tab the function of lifting the tab is decoupled from the popping and tearing function of the tab.

These objectives according to the invention are obtained with a tab for a closure, comprising a tab body having at one side a tab nose for opening the closure, and at the other side a tab lever having a finger opening for activating the tab lever, which finger opening is surrounded by a distal lever part connected by lateral lever legs to the tab body, wherein in the lever legs are formed aligned hinge parts in the form of lateral lever leg parts of reduced bending strength.

Due to the provision of hingable lateral lever leg parts of reduced bending strength aligned in the lever legs, the integral distal lever part is easy to lift out of the plane of the closure thereby facilitating the lifting of the tab for subsequent use by the user. The hingable lever leg parts are integral and formed in the lever legs which formation can be implemented in the standard tab formation process without interference. Due to the positioning of the hingable lever leg part in the tab lever an optimal torque is maintained due to the relatively large distance towards the rivet (or other connecting means) and relative to the small distance of the rivet to the tab nose. Surprisingly, it was found that the implementation of the lever leg part with reduced bending strength in a lever leg construction in which score or crack action is avoided, did not result in failure due to breakage in these lever leg parts when pop force and subsequent tear force are exerted by the user on the tab. In particular, use of the tab of the invention did not result in break due to failure in the lever leg parts of reduced bending strength formed in the lever legs of the tab lever. It was appreciated that the exertion of to and fro bending forces on the tab in several cycles did not result in failure. Apparently, the bending in the lateral lever leg parts beyond the yield point resulted in a strengthening of the bent zone and subsequent bending took place in an adjacent zone of the lever leg parts.

The reduction in bending strength in the lateral lever leg parts could be accomplished by reducing the cross sectional area by height and/or width. It is preferred that in the lateral lever leg parts the width is reduced such that sheet metal for producing the tab of the same thickness could be used. Reduction in width can be accomplished by cutting off material during other cutting operations in the method for producing the tab.

According to a preferred embodiment the aligned lateral lever leg parts reside in the zones of the lever legs remote of the tab body. It will be appreciated that the more remote the lever leg parts reside in the lever legs, the larger the lever and thereby the torque force. Accordingly, at the same pop force the user is to exert a lower lever force.

According to a preferred embodiment the bending strength or width of the lateral lever leg parts increases towards the tab body. As indicated above, the to and fro movement of the distal lever part will result in a bending in the lever leg parts. However, the bending which takes place first in the most remote zone will result in a strengthening in this zone. Accordingly, subsequent to and fro bending will result in a bending in a zone more proximal and thus at a higher bending strength. Thereby avoiding failure of the tab under to and fro bending in the most remote zones of the lateral lever leg parts.

In order to avoid that the user will injure his finger when sliding under the tab and when inserting the finger in the finger opening, it is preferred that the lateral lever leg parts are flat and adjacent lever leg parts are provided with inner and/or outer bended edges. Risk of injury of the finger of the user in the lateral lever leg parts of reduced bending size, it is preferred that the length of the lateral lever leg parts of reduced bending strength is such that contact with a users finger at the outer edge is substantially avoided. Due to an avoidance of contact injuries of the users finger is substantially avoided.

Another aspect of the present invention relates to a closure comprising a tab which is connected to the closure, preferably by a rivet, sealed or welded. The tab is characterized by the features as discussed above.

Another aspect of the present invention relates to a container provided with a closure having a tab according to the invention.

A final aspect of the present invention relates to a process for making a tab according to the present invention. This process is characterized in that it comprises the forming of a tab from sheet metal which tab comprises a tab body having at one side a tab nose and at the other side a tab lever having a dinger opening which is surrounded by a distal lever part connected by lateral lever legs to the tab body, and forming of aligned lateral lever leg parts of reduced bending strength in the lever legs. Evidently, the formation of the lateral lever parts with reduced bending sides can take place within the traditional tab making process without interference.

BRIEF DESCRIPTION OF THE DRAWINGS

Mentioned and other features of the tab, closure, container and process according to the present invention will be further illustrated by reference to several embodiments which are given for illustrative purposes and are not intended to limit the present invention to any extent. In this respect reference is made to the drawings in which:

FIG. 1 shows a container 1 provided with a closure 2 having a tab 3. The tab is connected to the closure 2 via a rivet 4.

DETAILED DESCRIPTION OF THE INVENTION

Figure 1:
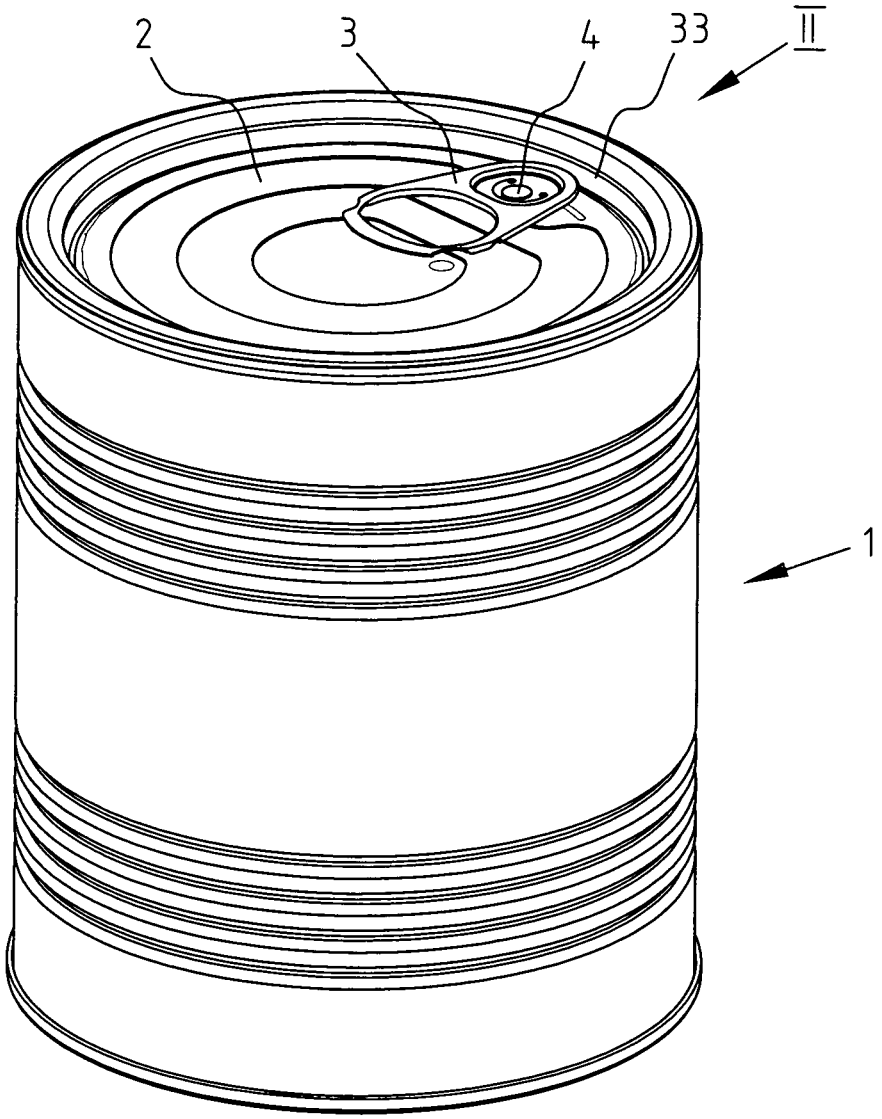
FIG. 1 shows a perspective view of a container provided with a closure having a tab according to the present invention.
Figure 2:
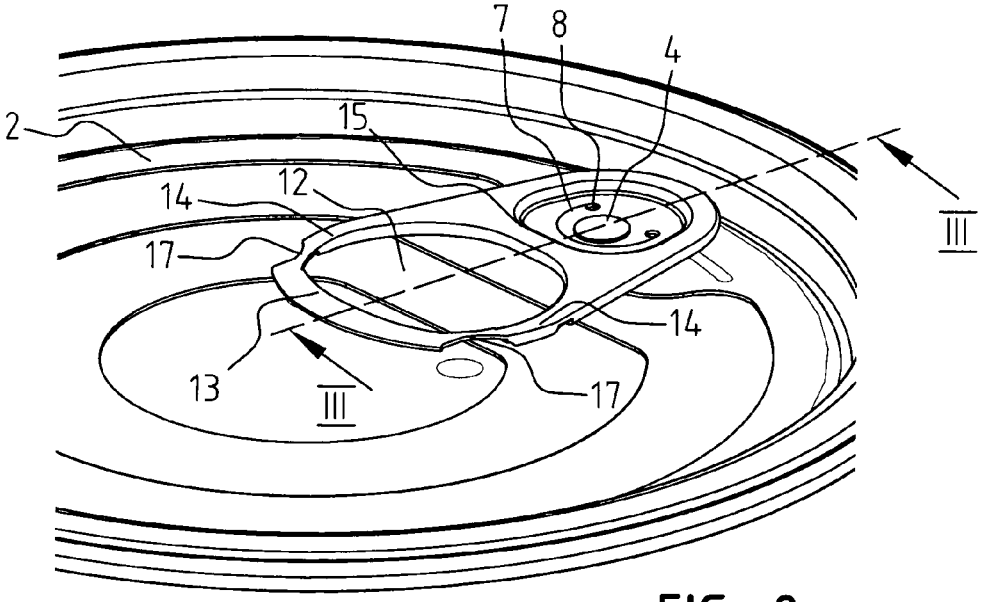
FIG. 2 shows at larger scale detail II of FIG. 1.

As shown in FIGS. 2-5, the tab comprises a tab body 5. The tab body 5 is provided with an opening 6 for the rivet 4. The opening 6 is partially surrounded by a narrow slot 7 ending in small apertures 8. Around a line 9 the tab may be tilted. Near this line 9 the tab body 5 is connected to the tab nose 10.

At the other side of the tab body 5 is connected to the tab body 5 a tab lever 11. The tab lever 11 is provided with a finger opening 12 which is surrounded by a distal lever part 13, lateral lever legs 14 and a proximal lever part 15.

The lever legs 14 are provided with hinge parts 16 in the form of lever leg parts 17 of reduced bending strength. As shown in FIGS. 2-5, the thickness of the sheet metal of the distal lever part 13, the lateral lever legs and the proximal lever legs is substantially the same. It is in the lever leg parts 17 of reduced bending strength that the width is reduced. The lever leg parts of reduced bending strength are aligned along the line 18 which is substantially parallel to the line 9 and perpendicular to the line 19 passing through the opening 6 and the ultimate part of the tab nose 10.

Figure 5:
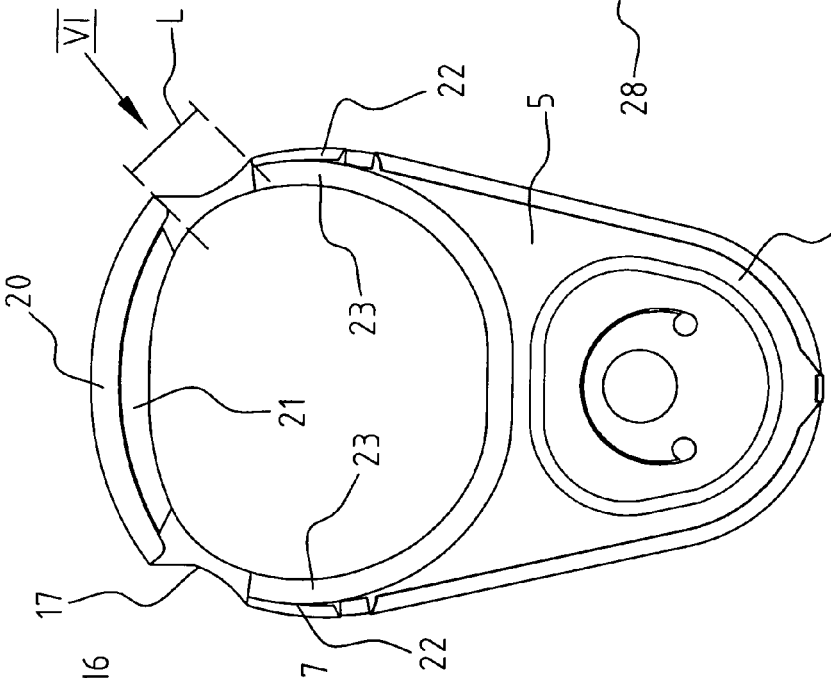
FIGS. 4 and 5 show a top view respectively bottom view of the tab shown in FIG. 2.
Figure 4:
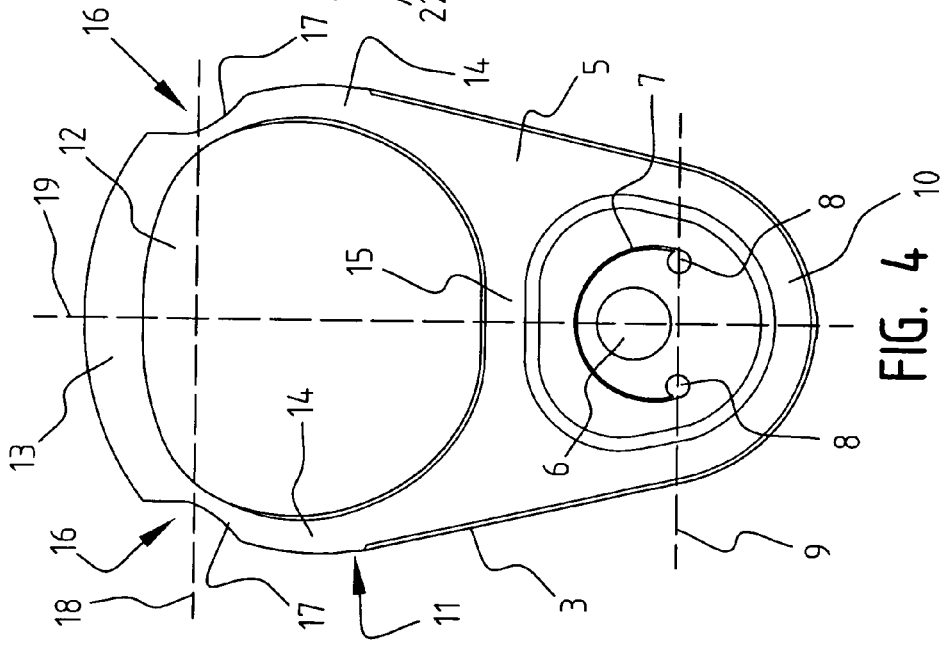

As shown in FIG. 5 (bottom side view) the distal lever part has an outer bended edge 20 and an inner bended edge 21. The lever legs are provided with similar outer bended edges 22 and inner bended edges 23. The bended edge 23 continues in the proximal lever part. The bended edge 22 continues over substantially the whole circumference of the tab body 5 and tab nose 10. Accordingly, although made of thin sheet metal, injury by the user is substantially avoided. Injury in the zone of the leg parts 17 is substantially avoided for reasons that at the outer edge the length L is such that direct contact with a users finger is substantially avoided.

Figure 6:
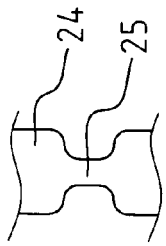
FIGS. 6 and 7 show alternative embodiments of detail V of FIG. 4.

FIG. 6 shows an alternative for the lever leg 24 provided with a lever leg part 25 of reduced bending strength. The width of the lever leg part of reduced bending strength is substantially the same over its length. Accordingly, when to and fro bending forces are applied there may be a risk for failure due to breakage after several bending cycles.

Figure 7:
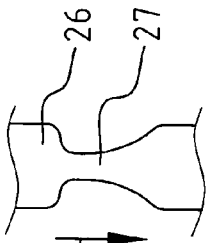

FIG. 7 shows an other alternative. The lever leg 26 is provided with a lever leg part 27 of which the width increases towards the tab body which is in the direction of the arrow 28. Thus, upon cycles of bending forces at an original bending line the strength of the material will be increased and subsequent bending will take place in an adjacent zone which is more towards the tab body, thus in the direction of the arrow 28.

Figure 3:
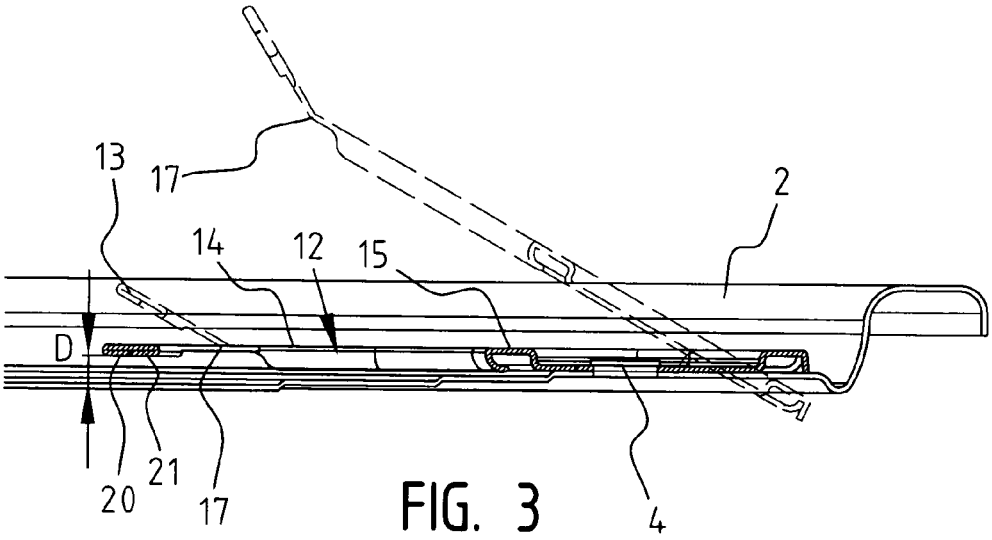
FIG. 3 shows a cross section according to line of FIG. 2 also showing the positions of the tab in FIGS. 7 and 8.
Figure 9:
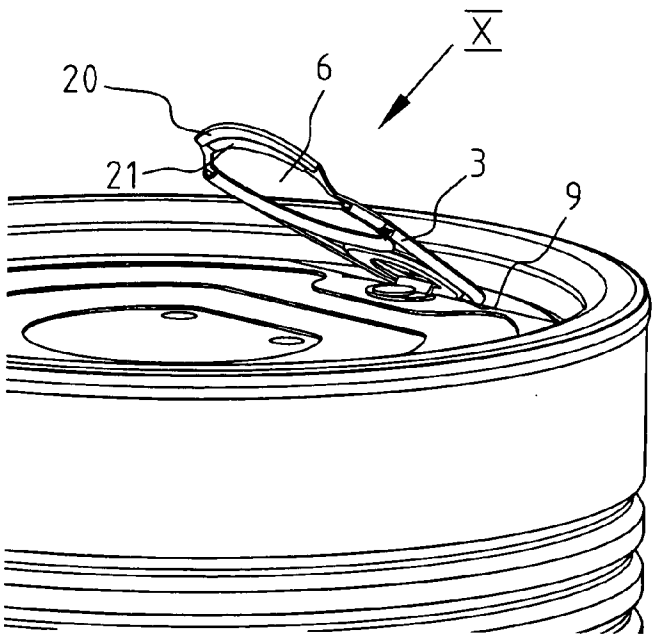
FIGS. 8 and 9 show respective views of the use of the tab shown in FIG. 2.
Figure 8:
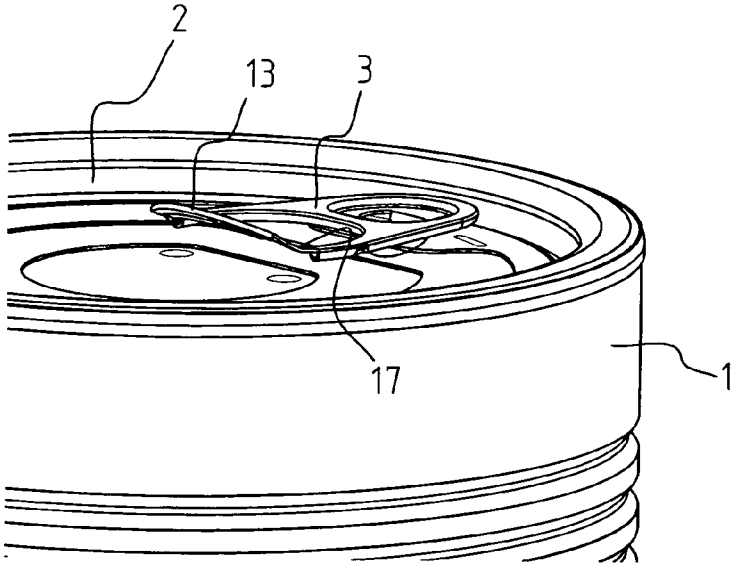

FIGS. 1, 8 and 9 and in particular FIG. 3, illustrate the use of a tab 3 according to the invention for opening the closure 2 of a container 1. The finger of the user (not shown) slides via an initial opening of about 1 mm into the space between the distal lever part 13 of the tab 3 and the closure 2. Upward movement of the finger away from the closure 2 will result in a bending of the distal lever part out off the tab plane into a position as shown in FIG. 7. This initial lifting or bending is possible at extremely low forces due to the lever leg parts 17 of reduced bending strength. At this stage the other parts of the tab 3, the tab body 5 and tab nose 10 remain in their original position.

FIG. 9 shows that levering the tab 3 by the user, preferably with his finger inserted in the opening 6 will result in a popping of the closure along the score line and a subsequently tearing off. As clearly shown in FIGS. 7 and 8, the bended outer edge 20 and inner edge 21 allow largest access of the users finger into the space beneath the distal lever part. At the same time these bended regions avoid users finger injuries.

Figure 10:
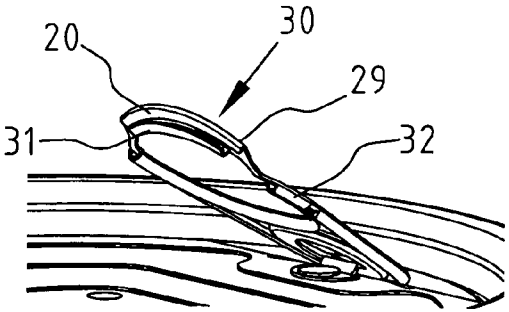
FIG. 10 is an alternative of detail IX of FIG. 8.

FIG. 10 shows an alternative tab 29. In this case the outer edge 20 of the distal lever part 30 is plied whereas the inner edge 31 is not plied but curled as are the inner edges 32 of the tab body and tab nose. This tab 30 provides maximum finger access and optimal use and avoidance of injuries.

Although described in relation to a tear off easy opening end, it will be appreciated that the tab according to the invention is suitable for use with any container closure requiring a partial tearing off or pushing inside of a closure part, thereby making access to the content of the container. Relevant is that the tab nose pops the container closure at a score line 33 where the opening is formed.

In the process of making a tab, a tab preform is formed by partially cutting out parts of a strip of sheet metal material. Subsequently, openings and apertures are formed and plied and curled edges are formed by operations carried out in the plane through the sheet of material out of which the tab is formed. It is in this type of operations that in the lever legs aligned lever leg parts are formed, preferably by cutting off material, thereby forming the parts of reduced bending strength. Clearly, the formation of the lateral lever leg parts can take place at the same time as the tab finger opening, the rivet opening and the apertures of the lever bending slots.

The invention claimed is:

1. A tab for a closure, comprising a tab body having at one side a tab nose for opening the closure, and at the other side a tab lever having a finger opening for activating the tab lever, which finger opening is surrounded by a distal lever part connected by lateral lever legs to the tab body, wherein in the lever legs are formed hinge parts comprised of aligned lateral lever leg parts of reduced bending strength, the lateral lever leg parts having a reduced width with the width of the lateral lever leg parts increasing towards the tab body such that the bending strength of the lateral lever leg parts increases towards the tab body and, upon cycles of bending forces at an original bending line, a strength of material forming the lateral lever leg parts increases such that subsequent bending takes place in an adjacent bending zone which is more towards the tab body and at a higher bending strength.

2. The tab according to claim 1, wherein the aligned lateral lever leg parts reside in the zones of the lever legs remote of the tab body.

3. The tab according to claim 1, wherein the length of the lateral lever leg parts of reduced bending strength is such that contact with a user's finger at the outer edge is substantially avoided.

4. A closure, comprising a tab connected to the closure, the tab comprising a tab body having at one side a tab nose for opening the closure, and at the other side a tab lever having a finger opening for activating the tab lever, which finger opening is surrounded by a distal lever part connected by lateral lever legs to the tab body, wherein in the lever legs are formed hinge parts comprised of aligned lateral lever leg parts of reduced bending strength, the lateral lever leg parts having a reduced width with the width of the lateral lever leg parts increasing towards the tab body such that the bending strength of the lateral lever leg parts increases towards the tab body and, upon cycles of bending forces at an original bending line, a strength of material forming the lateral lever leg parts increases such that subsequent bending takes place in an adjacent bending zone which is more towards the tab body and at a higher bending strength.

5. A container comprising a closure having a tab connected to the closure, the tab comprising a tab body having at one side a tab nose for opening the closure, and at the other side a tab lever having a finger opening for activating the tab lever, which finger opening is surrounded by a distal lever part connected by lateral lever legs to the tab body, wherein in the lever legs are formed hinge parts comprised of aligned lateral lever leg parts of reduced bending strength, the lateral lever leg parts having a reduced width with the width of the lateral lever leg parts increasing towards the tab body such that the bending strength of the lateral lever leg parts increases towards the tab body and, upon cycles of bending forces at an original bending line, a strength of material forming the lateral lever leg parts increases such that subsequent bending takes place in an adjacent bending zone which is more towards the tab body and at a higher bending strength.

* * * * *